US007517324B2

(12) United States Patent
Cohen

(10) Patent No.: US 7,517,324 B2
(45) Date of Patent: Apr. 14, 2009

(54) THERAPEUTIC BALL

(76) Inventor: Michael A. Cohen, 619 Lawrence Avenue West, Toronto, Ontario (CA) M6A 1A8

( * ) Notice: Subject to any disclaimer, the term of this patent is extended or adjusted under 35 U.S.C. 154(b) by 504 days.

(21) Appl. No.: 10/860,934

(22) Filed: Jun. 4, 2004

(65) Prior Publication Data

US 2004/0249322 A1 Dec. 9, 2004

Related U.S. Application Data

(60) Provisional application No. 60/475,700, filed on Jun. 4, 2003.

(51) Int. Cl.
*A61H 15/00* (2006.01)

(52) U.S. Cl. ..... 601/15; 601/135; 606/204

(58) Field of Classification Search ..... 601/15, 601/19, 21, 131–135; 606/204; D24/211, D24/214, 215

See application file for complete search history.

(56) References Cited

U.S. PATENT DOCUMENTS 2,466,470 A * 4/1949 Norris ..... 601/131
4,191,178 A * 3/1980 Wisnieski ..... 601/131
4,756,311 A * 7/1988 Francis, Jr. ..... 607/114
4,914,717 A * 4/1990 Gibbon ..... 219/759
5,284,272 A * 2/1994 Wei ..... 222/192
5,575,760 A * 11/1996 Masuda ..... 601/19
6,036,719 A * 3/2000 Meilus ..... 606/204
6,065,210 A * 5/2000 Bove ..... 29/895.21
6,193,740 B1 * 2/2001 Rodriguez ..... 606/204.25
6,499,485 B1 * 12/2002 Pepera ..... 128/845
6,974,427 B1 * 12/2005 Lapham ..... 601/120

FOREIGN PATENT DOCUMENTS

FR 2635974 A1 * 3/1990

OTHER PUBLICATIONS

Acu-Ball (www.squirrelslodge.com), Apr. 10, 2001.*

* cited by examiner

*Primary Examiner*—Steven O Douglas
(74) *Attorney, Agent, or Firm*—Colin P. Abrahams

(57) ABSTRACT

A therapeutic ball comprises an outer surface having a plurality of projections thereon, and an inner portion comprising a material selected for its ability to retain heat.

26 Claims, 3 Drawing Sheets

50
52
54
56
57
58
A
.130 GAP
.066 WALL
INSIDE ø2.889
ø.265 HOLE
ø3.021 BASE OF BALL
ø3.233 ACROSS TIPS
.140 WALL
SECTION A-A
R.421
R.005
R.035
R.132
.033
ø3.063 STEP FOR "PAT. PEND"
DETAIL A SCALE 2:1
R.050
R.005
30°

THERAPEUTIC BALL

CROSS REFERENCE TO RELATED APPLICATIONS

This application claims the benefit of U.S. Provisional Application No. 60/475,700 filed Jun. 4, 2003, which is incorporated herein in its entirety.

FIELD AND BACKGROUND OF THE INVENTION

This invention relates to a ball, or section of a ball, preferably a therapeutic ball, which may be used in treating various human conditions. More particularly, the therapeutic ball is used as a massage apparatus, and has as one of its principal uses the facilitation of muscle relief and tension, as well as reduction of pain in the back, neck, shoulder, hip, legs, feet, or such other part of the body, of a person being treated.

SUMMARY OF THE INVENTION

According to one aspect of the invention, there is provided a therapeutic ball comprising: an outer surface having a plurality of projections thereon; and an inner portion comprising a material selected for its ability to retain heat.

Preferably, the outer surface has one portion thereof which has a plurality of projections having a first size, and another portion having a plurality of projections thereon having a second size. At least one of the plurality of projections may comprise a projection of generally conical shape, and/or of generally hemi-spherical shape. At least one of the projections may comprise a base portion on the outer surface of the therapeutic ball, and a shaped portion mounted on the base portion.

In one form, the therapeutic ball further comprises at least one projection on the outer surface of the therapeutic ball having a third size.

Preferably, the inner portion comprises a central cavity, at least a part of which contains the material selected for its ability to retain heat. The inner portion may comprise a plurality of cavities formed beneath the outer surface, at least one of the plurality of cavities having a portion thereof which contains the material selected for its ability to retain heat.

The material selected for its ability to retain heat may comprise a mixture of silica and flax seed. The silica and flax seed may be present in relative proportions representing 50%-85% of the total, preferably about 25% silica and about 75% flax seed.

The first size projections may be larger than the second size projections, and present in numbers of about 6-16 per square inch, and the second size projections are present in numbers between about 20-40 projections per square inch.

In one embodiment, the therapeutic ball comprises a substantially half ball. The half ball may be mounted on a base.

According to another aspect of the invention, there is provided a method of forming a therapeutic ball for massage, the method comprising the steps of: forming a plurality of projections on an outer surface of the ball; locating a material selected for its ability to retain heat below the outer surface of the therapeutic ball; and providing heat to the material selected for its ability to retain heat.

According to yet a further aspect of the invention, there is provided a therapeutic massage device comprising: a massage application portion having an outer surface and a plurality of projections thereon; and a base portion upon which the massage application portion is mounted. Preferably, the therapeutic massage device further comprises an inner portion comprising a material selected for its ability to retain heat. The massage application portion may be of substantially hemispherical shape.

In one form, the base portion may be configured so as to form a gripping member by means of which the therapeutic massage device can be held so that the massage application portion can be applied to a person. Further, the base portion may have a flat base surface upon which the therapeutic massage device can be mounted.

In general, the therapeutic ball of the invention is utilized by applying the therapeutic ball to a specific area being treated, or laying the body part in need of muscle, or other treatment, on the therapeutic ball. The weight or force applied to the ball, or the weight of the body lying on the ball, has a massaging and/or therapeutic effect to help provide relief against tension and pain as described above.

In this specification, it should be understood that reference to the term "ball" is intended to include within its ambit a portion of ball, such as for example a half ball, which may optionally be mounted on a base or other structure to support it or provide it with better holding capability.

An important aspect of the therapeutic ball comprises a plurality of projections or nib-like extensions formed on the outer surface of the ball, the projections being shaped and configured for optimal effect.

A further aspect of the ball is a circumferential "belt" like region around or near the mid-section of the ball which accommodates the spinous processes of a user's vertebrae allowing a user to lie on his or her back directly on the ball.

Another important aspect of the invention relates to the fact that the core, center or other portion of the ball is filled with, or contains, a substance and/or material which is able to retain heat for a period of time after it has been heated, so that the retained heat remains present for a period of time in order that at least a portion of the massage or application of the therapeutic ball occurs with the retained heat. The ball is heated, preferably by boiling it or by placing it in a microwave oven, prior to use, and the heated ball together with the optimally configured projections and/or circumferential belt area thereon, when applied with pressure to various body parts, has been found to provide an advantageous benefit by relieving muscular and/or skeletal tension and/or pain.

Preferably, the projections or pointed nibs on the surface of the ball, and the heat and pressure therefrom, have been found to produce an acupressure-like effect in the tissue on which it is being worked and a releasing effect on the adjacent skeletal structures. Several beneficial effects have been found as a result of this combination. First, the massaging effect of the therapeutic ball, using pressure and heat, is likely to increase blood flow to the point at which it is applied, which may have the effect of flushing out built-up waste products that may have accumulated in tight muscle tissues over time. The removal of these waste products allows the muscle to return to its substantially normal relaxed lengthened state, as opposed to being in a shortened and tightened condition.

Another possible effect relates to the fact that the heated and pressured ball on the tissue may send messages to the central nervous system that a tight muscle condition is occurring, which in turn may result in a reciprocal message sent back to the muscle to relax and loosen it.

Another potential effect relates to the decrease in central nervous system irritability which may follow the relaxation of tight muscle segments, and opening between adjacent vertebrae and between the skull and vertebrae, which may be locked in spasm or habitually tightened states. The ball's circumferential belt area, where present, allows the spinous processes of the vertebrae to fit into the ball while adjacent paraspinal muscles receive an acupressure like effect from the ball's projections. This may create an intersegmental vertebral and occipito-vertebral loosening effect which may in turn decrease joint irritation and the concomitant central nervous system irritation which follows this.

Yet a further beneficial effect is the possible release of endorphins and other natural painkillers from the central nervous system, resulting in a self-healing pain relief, and enhanced feelings of well-being.

The therapeutic ball of the invention may be of any desired diameter, according to the nature and location of the tissue which is being treated. However, a diameter size of between 2 and 4 inches has been found to work well, and especially well when the diameter is between about 2.5 and 3.5 inches. An optimal diameter size may be considered at about 3 inches, which may provide the best configuration for effective loosening of many different body parts.

In one important aspect of the invention, the surface of the therapeutic ball has projections thereon which are of different sizes and configurations. In a preferred embodiment, "dual zones" are provided, one of these zones having larger projections arranged adjacent to each other, with the second zone having smaller such projections. This dual zone nature of the projections and the different sizes thereof preferably allows stimulation of thin muscles, such as those located in the temples at the side of the head, as well as thick muscles, such as those found in the lower back and at the bottom of the feet. The specific dimensions and shapes of the projections in these two zones preferably provide maximum effect at releasing and stimulating thin and thick muscle groups.

The larger projections are preferably modeled on the tip of a human finger, so as to provide a similar effect to that of a fingertip massage, since the fingertip has long been recognized as a "champion of muscle healing".

Another important aspect of the invention is that a hollowed-out interior of the therapeutic ball is filled with a substance, mixture or composition which can be heated, preferably in a microwave oven or by boiling, and will retain the heat for significant or longer periods of time while the therapeutic ball is used for massaging. While many different types of fill material can be used, it has been found that a mixture of water and a boiling point heightener substance provides a good fill material for the present purposes. In another preferred embodiment, a mixture of about 25% silica and about 75% flaxseed is used, although the relative proportions of these two components may vary so that each may be present in a small amount, such as about 5%, to significantly more amounts which could exceed 50-85% or more of the total.

The mix which is heated is preferably one that, upon about 60 seconds of heating in a microwave oven or 15 minutes of boiling, retains its heat for a significant period of time, sometimes for 30 minutes or more. However, any material which tends to prolong the heat retention capabilities of the therapeutic ball beyond that provided by the normal material from which the ball is constructed may be used. Indeed, the therapeutic ball of the invention can be used without a special fill material and be heated for use in a massage. Clearly, however, no material and/or different materials used will affect the length of time for which ball retains the heat.

In one preferred embodiment, the therapeutic ball of the invention has two sizes of projections. One size of these projections is such that they are present in numbers of about 6-16 per square inch, or in one preferred embodiment, about 7-8 per square inch. In the zone where the projections of smaller size are located, these are formed at densities of between about 20-40 such projections per square inch, although in one preferred form, a density of 25-30 projections per square inch is provided.

The projections or nibs may be of various different sizes and shapes, as will be discussed briefly below with respect to the drawings. Thus, the projections may have a conical end, a spherical end, or variations between these particular shapes. Preferably, these shaped portions are mounted on a raised bevel or pedestal, which forms between the projection and the surface of the ball.

In another embodiment of the invention, a half ball may be mounted on a holder, base or handle, the half ball having on its outer diameter the various projections of the type, configuration, duality and size discussed above. The half ball may be attached to a base of desired and selected shape to provide a good grip and manoeuverability to the therapeutic ball of the invention.

In one embodiment of the invention, the projections are spherical in shape. For the larger projections, the projections have a diameter of approximately 0.35 inches, while the smaller projections have a diameter of about 0.15 inches.

In another form of the invention, a part of the surface of the ball may have no projections formed thereon. This part of the surface may comprise about one quarter of the total surface area, although wide variations may be made according to the intended use of the ball. The portion of the surface of the ball which has no projections thereon may be used, for example, for more sensitive children's treatment, such as when a parent presses on a sore spot on a child's arm. The portion of the surface on which there are no projections may typically range between about 4-18% of the total, and about 15% of the total has been found to comprise a good area for the absence of such projections.

With respect to a ball of the invention which has both small projections and large projections, generally the small projections will occupy approximately 8-50% of the therapeutic ball surface, but in one preferred embodiment, will occupy about 15%. A preferred range may be between about 5-30%. With respect to the large projections, these may be formed over about 30-100% of the ball surface area, although a preferred range may be between 50-90%. It has been found that an area of about 70% works well, especially when used in combination with about 15% coverage of the small projection coverage. The surface of the ball may also be configured so as to have a single size projection only over all or a portion of the surface. Small and large projections may exist together side by side covering the entire ball, although a preferred embodiment features an area covering the middle two thirds of the ball.

The projections may be of any suitable shapes, such as conical, rounded, as described above, or otherwise, and sizes. The large nibs, in one preferred embodiment, have a height of about 0.21 inches each, and a radius of about 0.131 inches each. The small nibs or projections in one preferred embodiment only have a height of about 0.105 inches each, and a radius of about 0.053 inches each.

The circumferential belt running around the equator of the ball may have a diameter between about 0.05 to 2.0 inches. In a preferred embodiment, the belt may be about 0.130 inches in diameter.

The cavity is preferably about 95% filled, although a range of fill of between 50-100% may be suitably be used. However, the preferred embodiment is that 95% fill will occur.

Preferably, although the invention is not limited to this, the therapeutic ball is heated, usually about 60 seconds in a microwave oven, preferably at a medium heat setting, or with about 15 minutes of boiling, so it will be between about 3-10°

F. higher than body temperature. However, the ball may be heated to between 1-15° F. higher than the body temperature.

The fill material which is used to prolong heat retention may be in a central chamber in the ball. Alternately, or in addition, the material may be in one or a plurality of chambers or spaces, whether centrally located or at or near the surface of the ball.

DETAILED DESCRIPTION OF THE DRAWINGS

The invention is now described with respect to the accompanying drawings, which show preferred embodiments of the invention. It should, however, be noted that the invention comprises many embodiments not specifically illustrated, but which fall within the scope of the claims.

Figure 1:
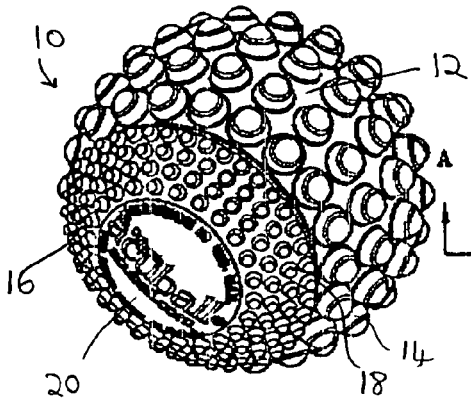
FIG. 1 is a perspective view of a therapeutic ball in accordance with one embodiment of the invention.

FIG. 1 shows a perspective view of a therapeutic ball 10 having an outer surface 12. The outer surface 12 is covered with a plurality of larger projections 14 in one area, and smaller projections 16 in another. A demarcation line 18 is provided between the small and large projections. The end 20 has no projections at all.

Figure 2:
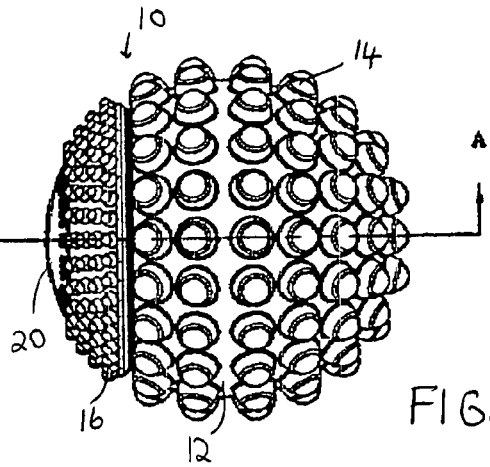
FIG. 2 is a top view of the therapeutic ball shown in FIG. 1 of the drawings.
Figure 3:
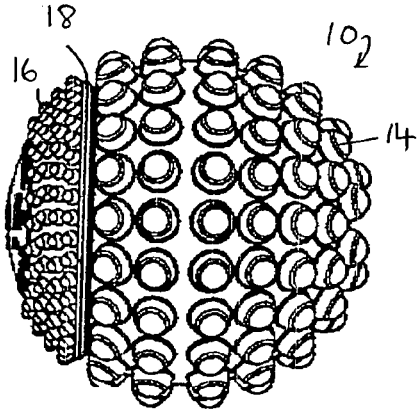
FIG. 3 is a side view of the therapeutic ball shown in FIG. 1 of the drawings.
Figure 4:
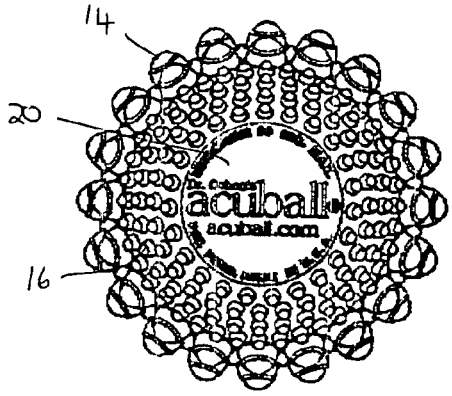
FIG. 4 is a front view of the therapeutic ball shown in FIG. 1 of the drawings.

FIG. 2 shows a top view of the therapeutic ball 10 shown in FIG. 1 of the drawings, while FIG. 3 shows a side view of the therapeutic ball 10 in FIG. 1 of the drawings. FIG. 4 shows a front view of the therapeutic ball 10 shown in FIG. 1, clearly illustrating a portion of the surface area with an absence of projections, described as end 20 above, whether of the smaller type 16 or larger type 14.

Figure 5:
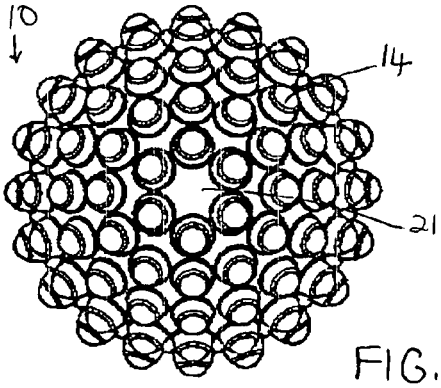
FIG. 5 is a rear view of the therapeutic ball shown in FIG. 1 of the drawings.

FIG. 5 shows a rear view of the therapeutic ball 10 shown in FIG. 1, in which only the large projections can be seen. An end area 21 is shown at the polar position of the therapeutic ball 10.

Figure 6:
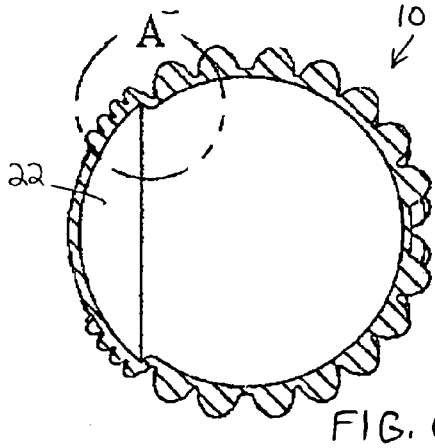
FIG. 6 shows a cross-section through the therapeutic ball shown in FIG. 1 of the drawings.

FIG. 6 shows a cross-section through the therapeutic ball 10 of the invention, including the fill space 22. Note that the fill space 22 shown in FIG. 6 of the drawings is represented as a large central cavity which is just below the outer surface of the therapeutic ball 10. However, it should be appreciated that the fill space 22 may be of any size or shape. Thus, the fill space 22 may be smaller than that which is shown in FIG. 6 and need not necessarily be of spherical shape. Furthermore, there may be a plurality of fill spaces 22 located at various positions within the therapeutic ball 10. These may, in one embodiment of the invention, comprise a plurality of cavities or spaces located beneath the surface of the therapeutic ball 10. The cavities may be optimally or selectively positioned to provide a residue of heat retained under certain selected portions of the therapeutic ball 10.

Figure 7:
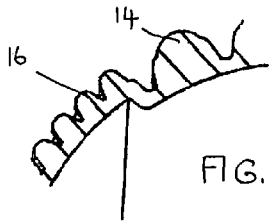
FIG. 7 shows a detail, in cross-section, of one section along the outer surface of the therapeutic ball.

FIG. 7 shows a detail of one section along the outer surface of the therapeutic ball 10, including the larger projections 14 and the smaller projections 16, and the transition from the one to the other.

Figure 8:
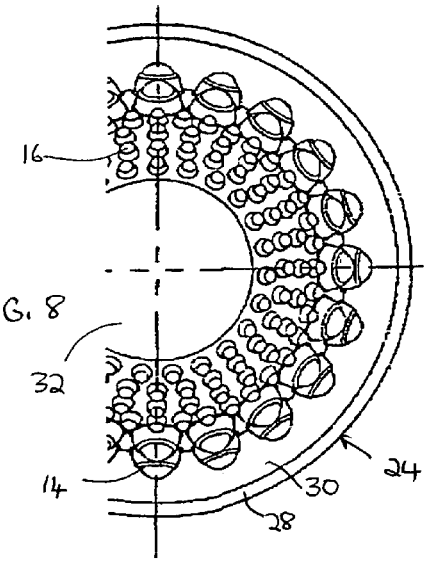
FIG. 8 shows, in part, a partial top view of a therapeutic ball in accordance with a further embodiment of the invention.
Figure 9:
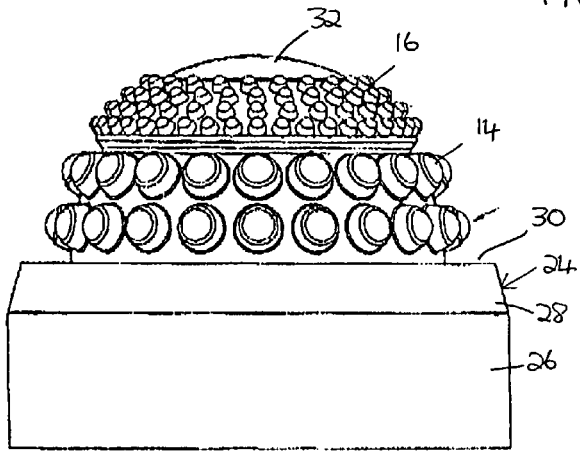
FIG. 9 show a side view of the therapeutic ball as illustrated in FIG. 8 of the drawings.
Figure 10:
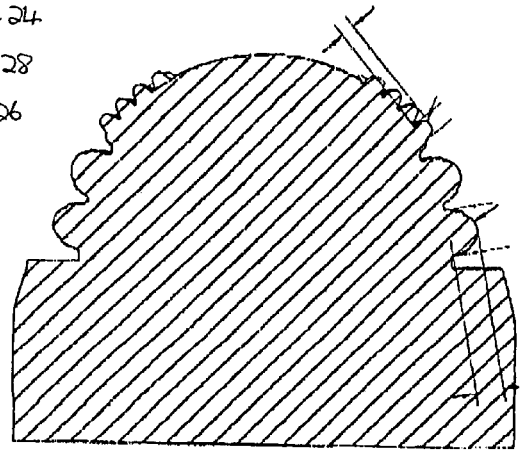
FIG. 10 shows a cross-section through the therapeutic ball shown in FIG. 9 of the drawings.

FIGS. 8, 9 and 10 of the drawings show another embodiment of the therapeutic ball of the present invention. FIG. 8 shows a partial top view, FIG. 9 shows a side view, and FIG. 10 shows a cross-section through the therapeutic ball according to this embodiment. Note that the interior of the therapeutic ball may also be heated for heat retention, and may contain a substance which is selected so as to retain heat for a prolonged period of time, as described above with reference to some of the preceding figures.

These FIGS. 8, 9 and 10 illustrate a generally half ball 32 of the invention mounted on a base 24. The base 24 comprises a lower section 26 and a beveled area 28. An upper surface 30 of the base 24 forms the surface upon which the half ball 32 of the therapeutic ball is mounted. In use, the base 24 can either be held by the user, or placed on a surface. When held, the half ball 32 can be pushed on the tissue or muscles of the person to be treated. When the lower section 26 is placed on a surface for use of the therapeutic ball in the stationary position, the person's body may then be placed over the half ball 32 so that the weight of the person's body provides the necessary pressure.

FIG. 10 shows a cross-section through the ball and base of FIG. 9, with the various components.

It should be noted that all of the illustrations in the Figures described above may have smaller and larger projections which are of the type described in the specification. Thus, the overall dimensions may vary, the coverage may vary, and the shape and size of the various projections may be adjusted. Further, a particular ball may have more than just two different sizes of projections, and three or more different types or sizes of projection on the surface of the therapeutic ball may be provided.

Figure 11:
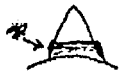
FIG. 11 is a schematic illustration of a small projection which may be used with the therapeutic ball of the invention.
Figure 12:
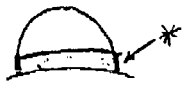
FIG. 12 is a schematic illustration of another small projection which may be used with the therapeutic ball of the invention.
Figure 13:
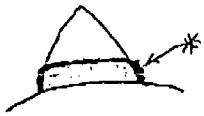
FIG. 13 is a schematic illustration of a larger projection which may be used with the therapeutic ball of the invention.
Figure 14:
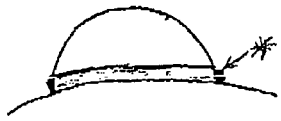
FIG. 14 is a schematic illustration of another larger projection which may be used with the therapeutic ball of the invention.

A detail of selected various projections is shown in FIGS. 11 to 14 of the drawings. It should be noted that the invention is not limited to projections of the configuration and dimension illustrated in these figures. Thus, FIG. 11 shows a small projection having a conical shape, mounted on a bevel which is intermediate the projection and the surface of the ball. FIG. 12 also shows a small projection, but this time having a hemi-spherical or circular shape, including the bevel. FIGS. 13 and 14 are substantially similar to those shown in FIGS. 11 and 12, but represent a larger projection, where the dimensions are simply bigger than those in FIGS. 11 and 12. Relatively smaller or larger projections than those shown may be constructed on to the outer surface of the ball.

FIGS. 15 to 22 illustrate a further embodiment of the intention, somewhat similar to that shown in FIGS. 1 to 7 of drawings.

Figures 15, 16, 17, 18, 19, 20, 21, 22:
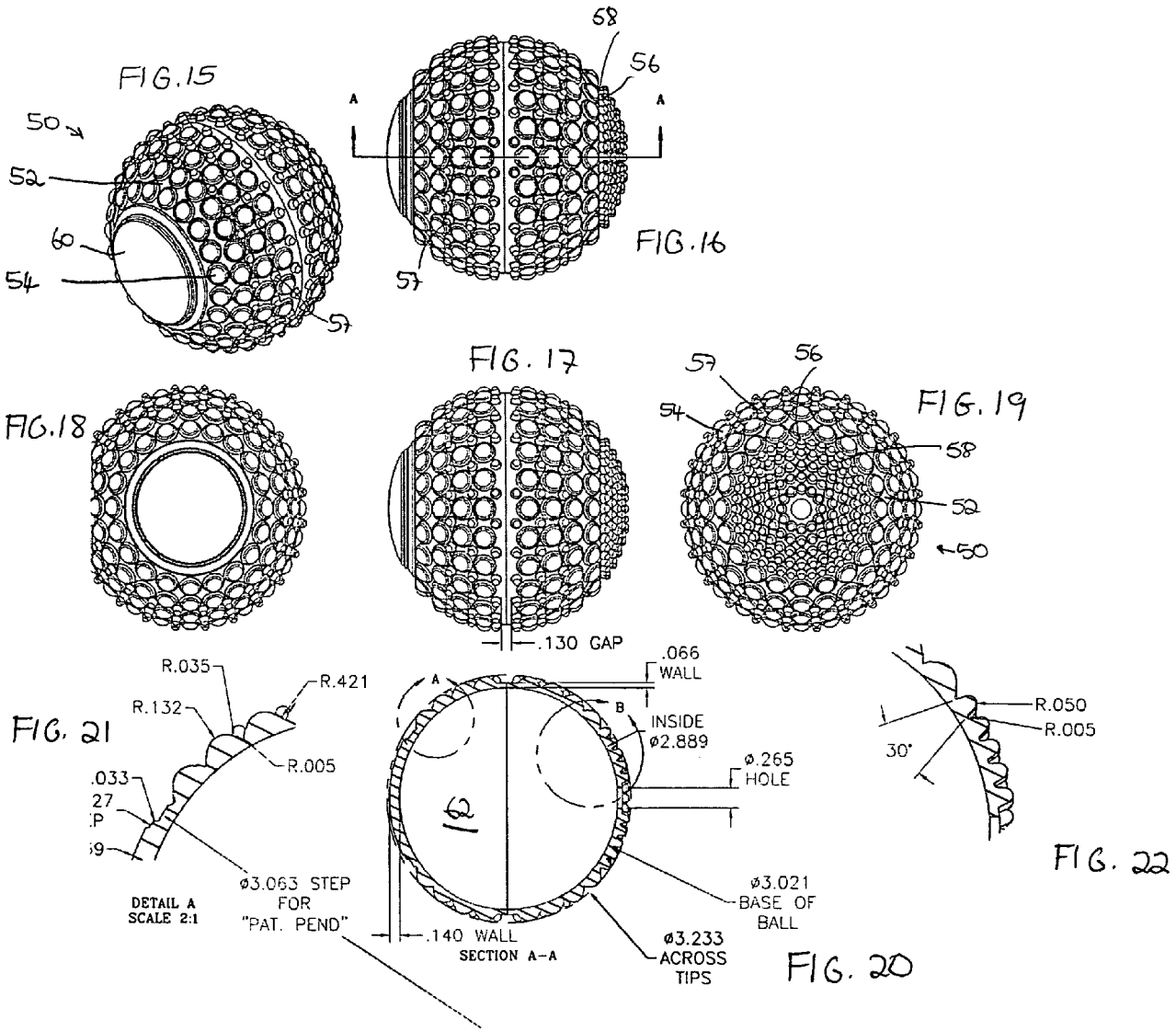
FIG. 15 is a perspective view of the therapeutic ball in accordance with yet a further embodiment of the invention.
FIG. 16 shows a top view of the therapeutic ball shown in FIG. 15 of the drawings.
FIG. 17 shows a side view of the therapeutic ball shown in FIG. 15 of the drawings.
FIG. 18 shows a front view of the therapeutic ball shown in FIG. 15 of the drawings.
FIG. 19 shows a rear view of the therapeutic ball shown in FIG. 15 of the drawings.
FIG. 20 shows a cross-section through the therapeutic ball shown in FIG. 15 of the drawings.
FIG. 21 shows a detail of circle A of FIG. 20 of the drawings.
FIG. 22 shows a detail of circle B of FIG. 20 of the drawings.

FIG. 15 shows a perspective view of a therapeutic ball 50 having an outer surface 52. The outer surface 52 is covered with a plurality of larger projections 54 in one area, and smaller projections 56 in another. Among the larger projections 54, there are interspersed at predetermined locations a plurality of secondary projections 57, which may be of the same size, larger, or smaller than the small projections 56. The projections 56 and 57 may also have the same or different shapes and/or configurations. A demarcation line 58 is provided between the small and large projections 56 and 54 respectively. The end 60 has no projections at all.

FIG. 16 shows a top view of the therapeutic ball 50 shown in FIG. 15 of the drawings, while FIG. 17 shows a side view of the ball 50 in FIG. 15 of the drawings. FIG. 18 shows a front view of the ball shown in FIG. 15, clearly illustrating a portion of the surface area with an absence of projections, having reference numeral 60, whether of the smaller type 56 or larger type 54.

FIG. 19 shows a rear view of the ball 50 shown in FIG. 15, in which all of the different sized projections 54, 56 and 57 can be seen.

FIG. 20 shows a cross-section through the therapeutic ball of the invention 50, including the fill space 62. FIGS. 21 and 22 show different details of the outer surface at two different locations thereof, indicated by the presence of the circles A and B in FIG. 20 of the drawings. These FIGS. 21 and 22 show the larger 54, smaller 56 and secondary projections 57, as appropriate, and the transition and interrelationship from the one to the other.

FIGS. 15 to 22 include certain preferred dimensions of the therapeutic ball 50 of the invention, although it must be appreciated that the invention is not limited to these specific forms.

The invention is not limited to the precise details described herein, and may vary to provide the same effect. For example, the invention may be made of various thermoplastics or other materials including rubber and/or poly vinyl chloride. One embodiment utilizes solely poly vinyl chloride.

The invention claimed is:

1. A therapeutic ball comprising:

an outer surface having a plurality of projections thereon and covering substantially the entire outer surface, the outer surface having a substantially central linear circumferential portion defining a continuous recessed surface pathway without projections thereon, the recessed surface pathway for receiving spinous processes and the projections on either side of the recessed surface pathway for acting on muscle adjacent the spinous processes; and an inner portion comprising a material selected for its ability to retain heat, the material being water.

2. A therapeutic ball as claimed in claim 1 wherein the outer surface has one portion thereof which has a plurality of projections having a first size, and another portion having a plurality of projections thereon having a second size.

3. A therapeutic ball as claimed in claim 1 wherein at least one of the plurality of projections comprises a projection of generally conical shape.

4. A therapeutic ball as claimed in claim 1 wherein at least one of the plurality of projections comprises a projection of generally hemi-spherical shape.

5. A therapeutic ball as claimed in claim 1 wherein at least one of the projections comprises a base portion on the outer surface of the therapeutic ball, and a shaped portion mounted on the base portion.

6. A therapeutic ball as claimed in claim 2 further comprising at least one projection on the outer surface of the therapeutic ball having a third size.

7. A therapeutic ball as claimed in claim 1 wherein at least a portion of the outer surface has absence of projections.

8. A therapeutic ball as claimed in claim 1 wherein the inner portion comprises a central cavity, at least a part of which contains the material selected for its ability to retain heat.

9. A therapeutic ball as claimed in claim 1 wherein the inner portion comprises a plurality of cavities formed beneath the outer surface, at least one of the plurality of cavities having a portion thereof which contains the material selected for its ability to retain heat.

10. A therapeutic ball as claimed in claim 1 wherein the material selected for its ability to retain heat further comprises a mixture of silica and flax seed.

11. A therapeutic ball as claimed in claim 10 wherein each of the silica and flax seed may be present in relative proportions representing 50%-85% of the total.

12. A therapeutic ball as claimed in claim 10 wherein the mixture comprises about 25% silica and about 75% flax seed.

13. A therapeutic ball as claimed in claim 2 wherein the first size projections are larger than the second size projections, and present in numbers of about 6-16 per square inch, and the second size projections are present in numbers between about 20-40 projections per square inch.

14. A therapeutic ball as claimed in claim 1 which comprises a substantially half ball.

15. A therapeutic ball as claimed in claim 14 wherein the half ball is mounted on a base.

16. A therapeutic ball as claimed in claim 2 wherein the first size projections are larger projections formed over about 30%-100% of the outer surface, and the second size projections are smaller projections which are formed over approximately 8%-50% of the outer surface.

17. A therapeutic ball as claimed in claim 16 wherein the first size projections are formed over approximately 70% of the outer surface, and the second size projections are formed over about 15% of the outer surface, the remaining part of the outer surface having no projections thereon.

18. A therapeutic ball as claimed in claim 2 wherein the first size projections have a diameter of approximately 0.35 inches, and the second size projections have a diameter of about 0.15 inches.

19. A therapeutic ball as claimed in claim 1 wherein at least 25% of the outer surface has an absence of projections.

20. A therapeutic massage device comprising:

a massage application portion having an outer surface and a plurality of projections thereon and covering substantially the entire outer surface, the outer surface having a substantially central portion defining a continuous recessed surface pathway without projections thereon, the surface pathway for receiving spinous processes and the projections on either side of the recessed surface pathway for acting on muscle adjacent the spinous processes; and a base portion upon which the massage application portion is mounted.

21. A therapeutic massage device as claimed in claim 20 further comprising an inner portion comprising a material selected for its ability to retain heat, the material comprising water.

22. A therapeutic massage device as claimed in claim 20 wherein the massage application portion is of substantially hemispherical shape.

23. A therapeutic massage device as claimed in claim 20 wherein the base portion is configured so as to form a gripping member by means of which the therapeutic massage device can be held so that the massage application portion can be applied to a person.

24. A therapeutic massage device as claimed in claim 20 wherein the base portion has a flat base surface upon which the therapeutic massage device can be mounted.

25. A therapeutic ball as claimed in claim 1 wherein the ball has an equator and the pathway is located at or near the equator.

26. A therapeutic ball as claimed in claim 1 wherein the ball has an equator and the pathway is located away from the equator.

* * * * *